US011069954B2

(12) United States Patent
Kim et al.

(10) Patent No.: US 11,069,954 B2
(45) Date of Patent: Jul. 20, 2021

(54) CHIP ANTENNA

(71) Applicant: Samsung Electro-Mechanics Co., Ltd., Suwon-si (KR)

(72) Inventors: Chin Mo Kim, Suwon-si (KR); Jae Yeong Kim, Suwon-si (KR); Sung Yong An, Suwon-si (KR); Sung Nam Cho, Suwon-si (KR); Ji Hyung Jung, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/788,585

(22) Filed: Feb. 12, 2020

(65) Prior Publication Data

US 2021/0111478 A1 Apr. 15, 2021

(30) Foreign Application Priority Data

Oct. 11, 2019 (KR) ..... 10-2019-0125950

(51) Int. Cl.

| | |
|---|---|
| ***H01Q 1/38*** | (2006.01) |
| ***H01Q 1/22*** | (2006.01) |
| ***H01Q 9/04*** | (2006.01) |
| ***H01Q 1/42*** | (2006.01) |
| ***H01Q 21/06*** | (2006.01) |

(52) U.S. Cl.

CPC ..... *H01Q 1/2283* (2013.01); *H01Q 1/422* (2013.01); *H01Q 9/0407* (2013.01); *H01Q 21/065* (2013.01)

(58) Field of Classification Search

CPC .... H01Q 1/2283; H01Q 1/422; H01Q 9/0407; H01Q 21/065

USPC ..... 343/700 R

See application file for complete search history.

(56) References Cited

U.S. PATENT DOCUMENTS

| | | | | |
|---|---|---|---|---|
| 2004/0189527 | A1* | 9/2004 | Killen | H01Q 9/0414 343/700 MS |
| 2011/0169706 | A1* | 7/2011 | Wintels | H01Q 21/065 343/720 |
| 2017/0229784 | A1 | 8/2017 | Kitamura et al. | |

FOREIGN PATENT DOCUMENTS

| | | |
|---|---|---|
| JP | 6336107 B2 | 6/2018 |
| KR | 10-1489577 B1 | 2/2015 |

* cited by examiner

*Primary Examiner* — Peguy Jean Pierre
(74) *Attorney, Agent, or Firm* — NSIP Law

(57) ABSTRACT

A chip antenna includes a first dielectric substrate, a second dielectric substrate spaced apart from and opposing the first dielectric substrate, a first patch disposed on the first dielectric substrate, a second patch disposed on the second dielectric substrate, and a mounting pad and a feed pad disposed on a mounting surface of the first dielectric substrate. The first dielectric substrate, mounted on a mounting substrate through the mounting pad, is electrically connected to the mounting substrate through the feed pad. One of the first dielectric substrate and the second dielectric substrate is formed of ceramic and another is formed of polytetrafluoroethylene (PTFE).

17 Claims, 17 Drawing Sheets

CHIP ANTENNA

CROSS-REFERENCE TO RELATED APPLICATION(S)

This application claims the benefit under 35 USC 119(a) of Korean Patent Application No. 10-2019-0125950 filed on Oct. 11, 2019 in the Korean Intellectual Property Office, the entire disclosure of which is incorporated herein by reference for all purposes.

BACKGROUND

1. Field

The present disclosure relates to a chip antenna.

2. Description of Related Art 5G communication systems are implemented in higher frequency (mmWave) bands, such as 10 GHz to 100 GHz bands, in order to achieve higher data transfer rates. In order to reduce the propagation loss of, and increase the transmission distance of, an RF signal, beamforming, large-scale multiple-input multiple-output (MIMO), full dimensional multiple-input multiple-output (MIMO), array antennas, analog beamforming, and large-scale antenna techniques are being discussed in 5G communication systems.

Mobile communication terminals, such as mobile phones, PDAs, navigation systems, laptop computers, supporting wireless communications, are part of a developing trend of added functions, such as CDMA, wireless LAN, DMB, and near field communication (NFC), and are enabled through an antenna of the mobile communication terminals.

However, in a GHz band used in a 5G communication system, it may be difficult to use a conventional antenna because the wavelength in the GHz band is reduced to several millimeter (mm). Therefore, a chip antenna module, suitable for a GHz band, while being extremely small in size, to be mounted in a mobile communications terminal, is desired.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna includes a first dielectric substrate, a second dielectric substrate spaced apart from and opposing the first dielectric substrate, a first patch disposed on the first dielectric substrate, a second patch disposed on the second dielectric substrate, and a mounting pad and a feed pad disposed on a mounting surface of the first dielectric substrate. The first dielectric substrate, mounted on a mounting substrate through the mounting pad, is electrically connected to the mounting substrate through the feed pad. One of the first dielectric substrate and the second dielectric substrate is formed of ceramic and another is formed of polytetrafluoroethylene (PTFE).

The first dielectric substrate may be formed of ceramic and the second dielectric substrate is formed of PTFE.

The first dielectric substrate may be formed of PTFE and the second dielectric substrate is formed of ceramic.

The first patch may be disposed on one surface of the first dielectric substrate opposing the second dielectric substrate. The chip antenna may further include at least one first feed via extended in a thickness direction of the first dielectric substrate and connected to the first patch.

The second patch may be disposed on one surface of the second dielectric substrate opposing the first dielectric substrate. The chip antenna may further include at least one second feed via extended in a thickness direction of the first dielectric substrate, passing through a through-hole of the first patch, and connected to the second patch.

The chip antenna may further include a plurality of shielding vias disposed around the at least one second feed via.

The chip antenna may further include a third patch disposed on the another surface opposite to the one surface of the second dielectric substrate.

The chip antenna may further include a spacer disposed between the first dielectric substrate and the second dielectric substrate.

The chip antenna may further include a bonding layer disposed between the first dielectric substrate and the second dielectric substrate.

In another general aspect, a chip antenna includes a dielectric substrate portion, a patch portion, a mounting pad and a feed pad. The dielectric substrate portion includes a first dielectric substrate stacked on a second dielectric substrate. The patch portion includes a first patch and a second patch, sequentially provided in the dielectric substrate portion, and spaced apart from each other. The mounting pad and a feed pad are disposed on a mounting surface of the first dielectric substrate. The first dielectric substrate, mounted on a mounting substrate through the mounting pad, is electrically connected to the mounting substrate through the feed pad. One of the first dielectric substrate and the second dielectric substrate is formed of ceramic and another is formed of PTFE.

The first dielectric substrate and the second dielectric substrate may be directly bonded to each other.

One of the first dielectric substrate and the second dielectric substrate formed of PTFE may embed one of the first patch and the second patch.

The first dielectric substrate may be formed of ceramic and the second dielectric substrate is formed of PTFE.

The first patch, disposed on one surface of the first dielectric substrate bonded to the second dielectric substrate, may protrude towards the second dielectric substrate, and the second patch may be embedded inside the second dielectric substrate.

The first dielectric substrate may be formed of PTFE and the second dielectric substrate may be formed of ceramic.

The first patch may be embedded inside the first dielectric substrate, and the second patch, disposed on one surface of the second dielectric substrate bonded to the first dielectric substrate, may protrude towards the first dielectric substrate.

In another general aspect, a chip antenna includes a first patch disposed on a first dielectric substrate, and a second patch, spaced apart from the first patch, disposed on a second dielectric substrate. The first dielectric substrate is connected to a mounting substrate through a feed pad. One of the first dielectric substrate and the second dielectric substrate is formed of ceramic and another is formed of polytetrafluoroethylene (PTFE).

The first dielectric substrate and the second dielectric substrate may be directly bonded to each other.

One of the first dielectric substrate and the second dielectric substrate formed of PTFE may embed one of the first patch and the second patch.

The first patch, disposed on one surface of the first dielectric substrate bonded to the second dielectric substrate, may protrude towards the second dielectric substrate. The second patch may be embedded inside the second dielectric substrate.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
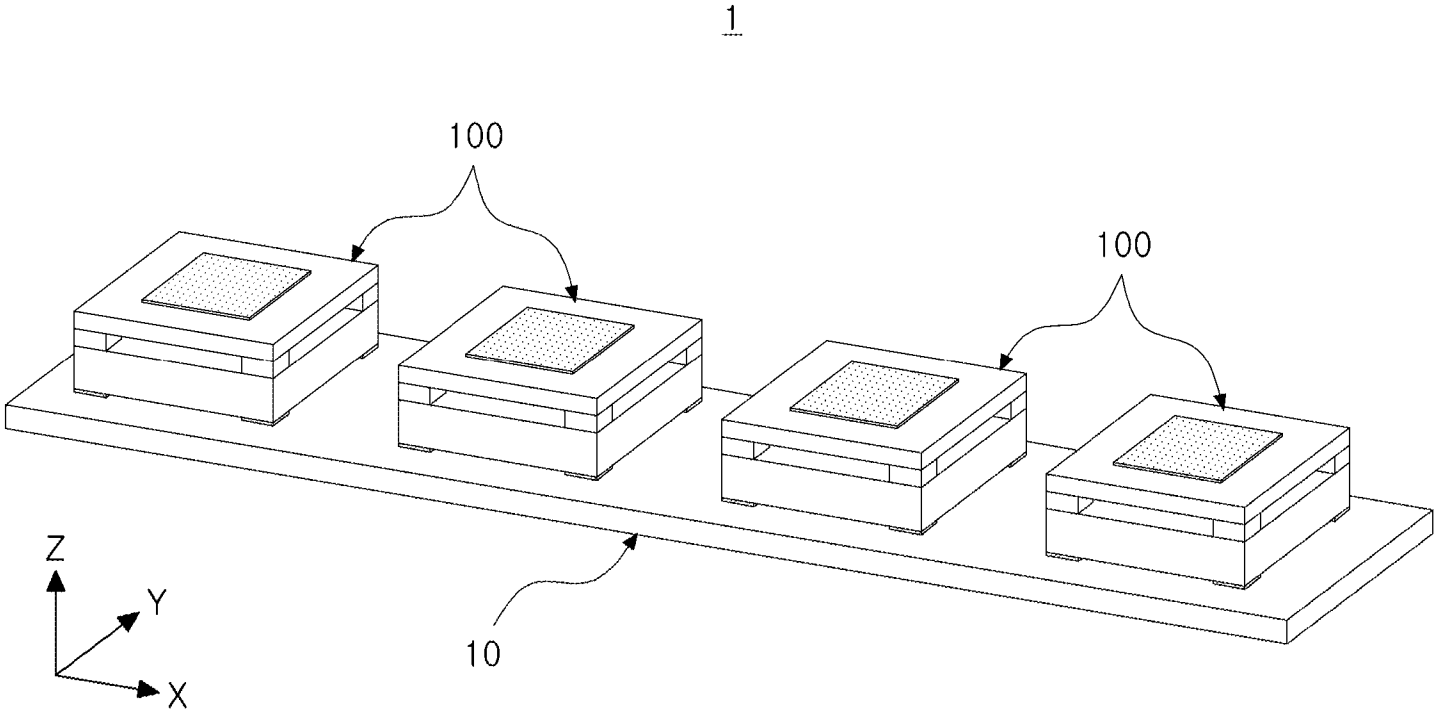
FIG. 1 is a perspective view of an example of a chip antenna module according to an embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The contents of the present disclosure described below may have a variety of configurations and propose only a required configuration herein, but are not limited thereto.

The chip antenna module described in the present specification is operated in a high frequency region and, for example, may be operated in a frequency band of 3 GHz or more. In addition, the chip antenna module described herein may be mounted on an electronic device configured to receive or transmit a radio frequency (RF) signal. For example, the chip antenna may be mounted on a mobile phone, a portable laptop, a drone, or the like.

Figure 2:
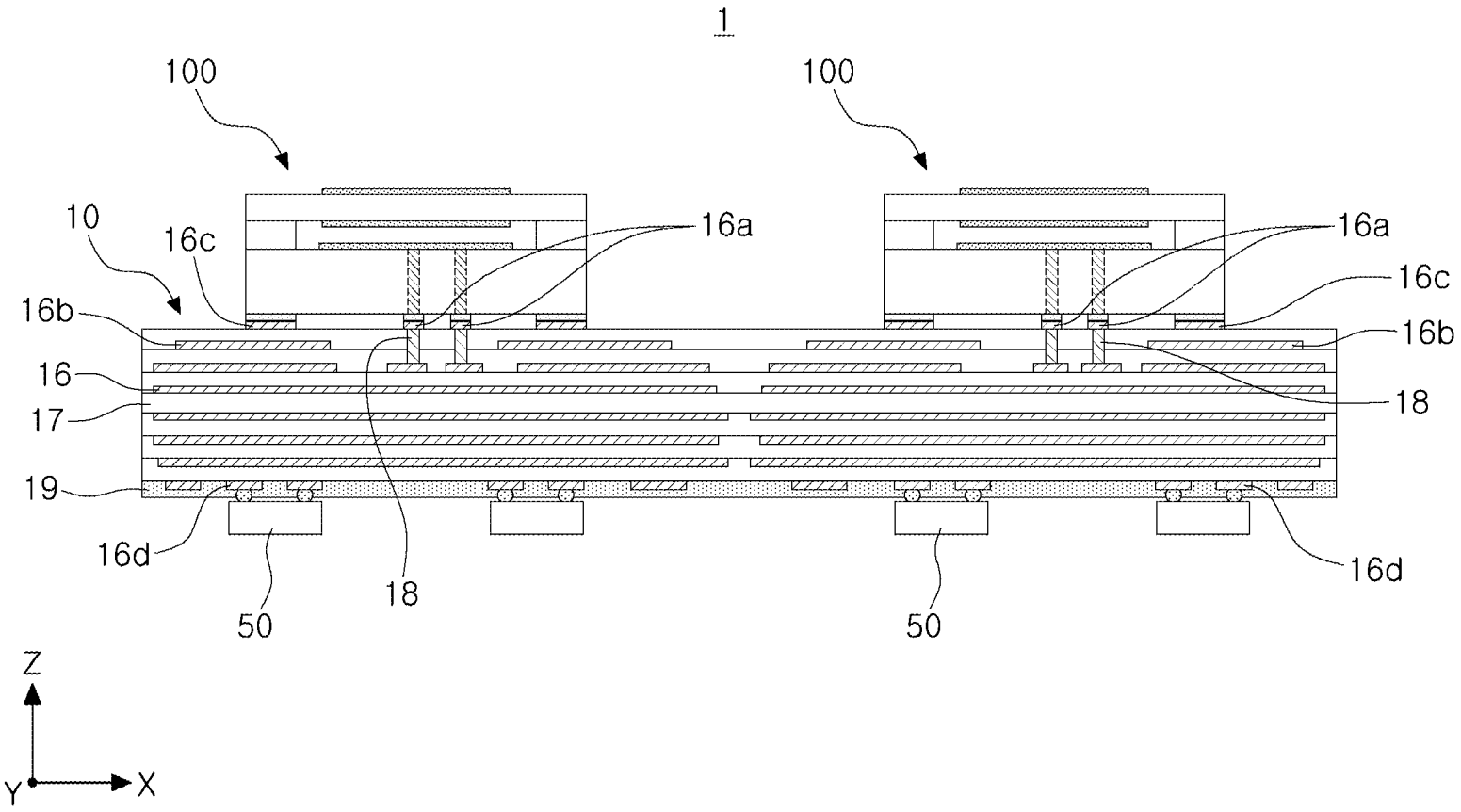
FIG. 2 is a cross-sectional view of a portion of the chip antenna module of FIG. 1.
Figure 3A:
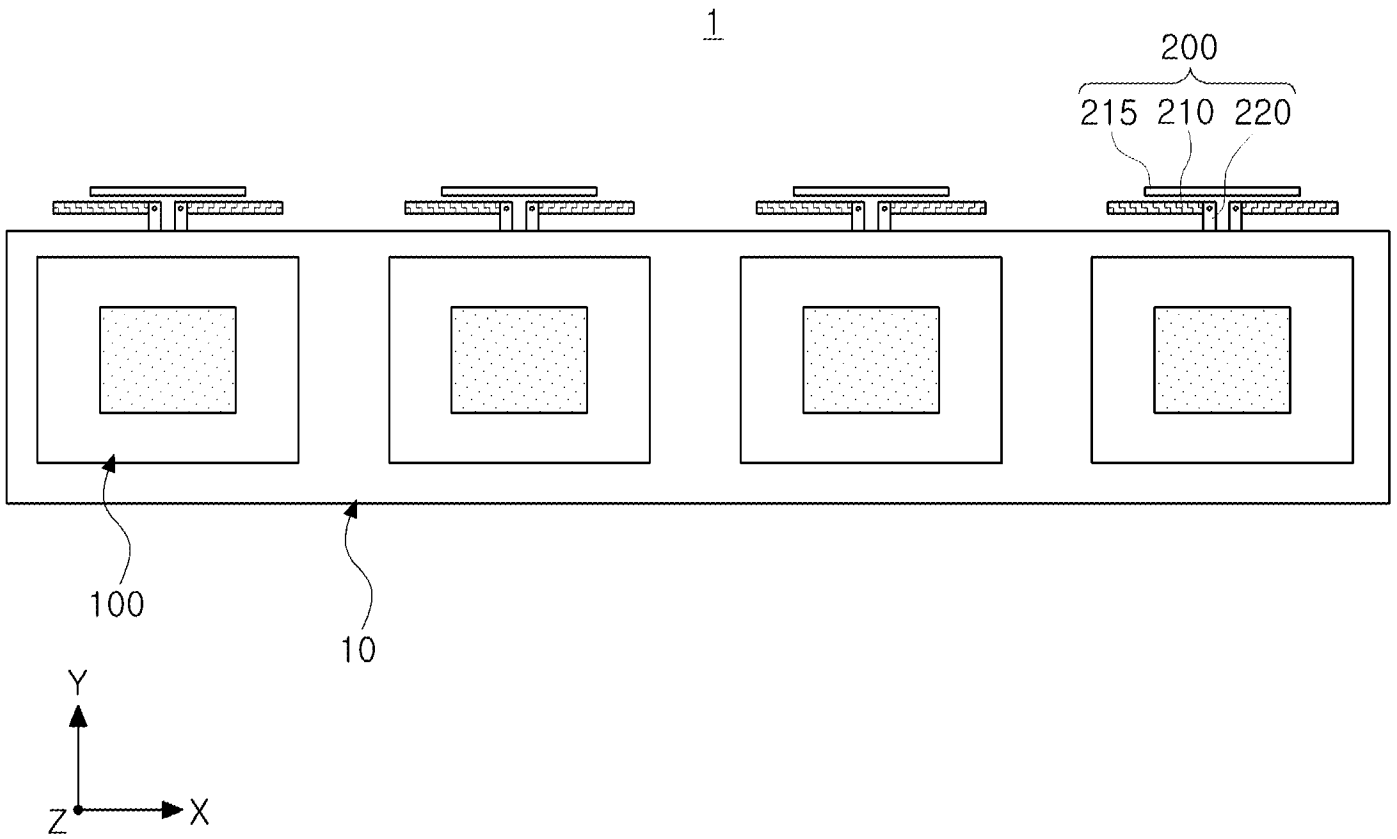
FIG. 3A is a plan view of the chip antenna module of FIG. 1.
Figure 3B:
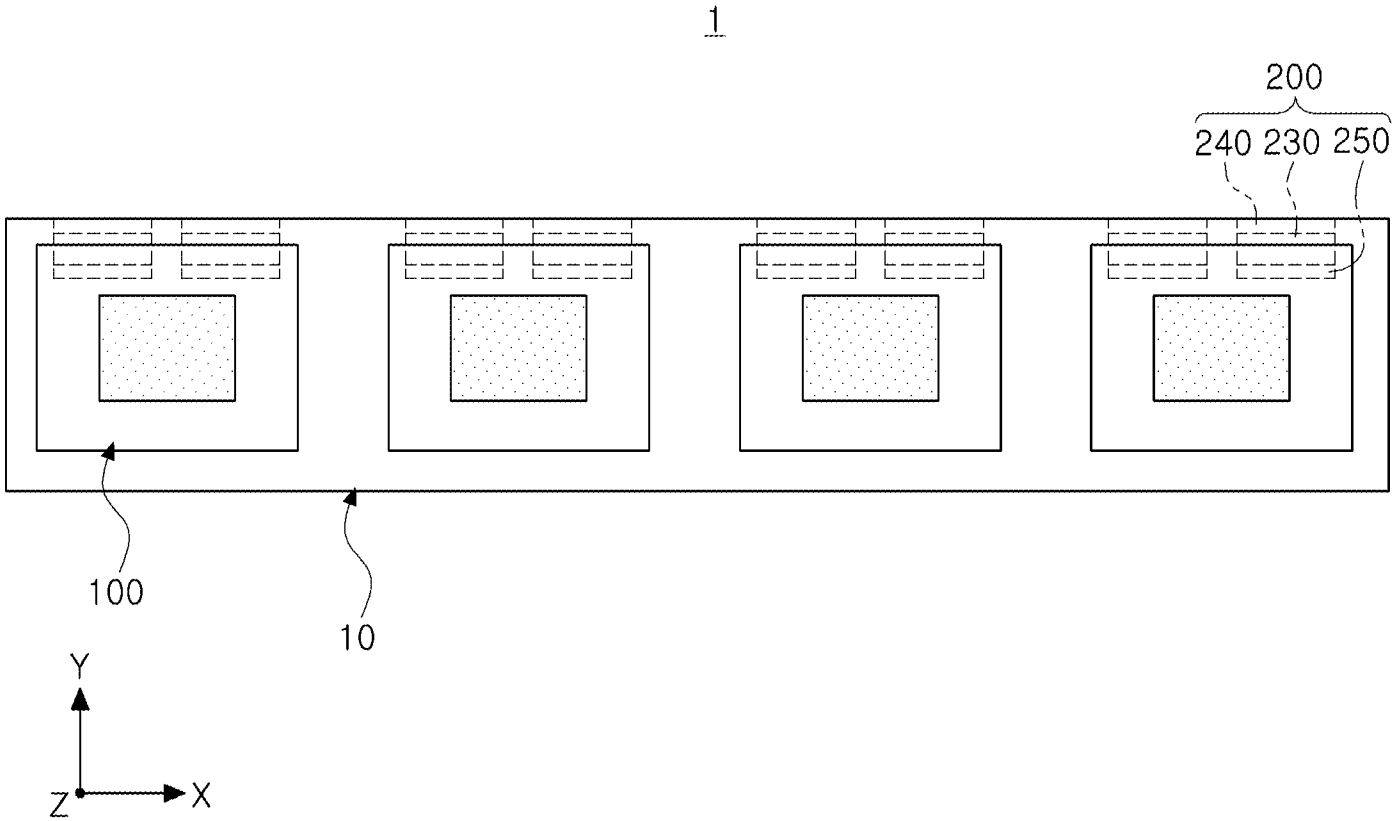
FIG. 3B illustrates a modified embodiment of the chip antenna module of FIG. 3A.

FIG. 1 is a perspective view of a chip antenna module according to an embodiment of the present disclosure. FIG. 2 is a cross-sectional view of a portion of the chip antenna module of FIG. 1. FIG. 3A is a plan view of the chip antenna module of FIG. 1 and FIG. 3B illustrates a modified embodiment of the chip antenna module of FIG. 3A.

Referring to FIGS. 1, 2, and 3A, a chip antenna module 1, according to an embodiment, includes a mounting substrate 10, at least one electronic device 50, and a plurality of chip antennas 100, and may further include a plurality of end-fire antennas 200. At least, one electronic device 50, a plurality of chip antennas 100, and a plurality of end-fire antennas 200 may be disposed on the mounting substrate 10.

The mounting substrate 10 may be a circuit board with a circuit or an electronic component, required for the chip antenna 100. As an example, the mounting substrate 10 may be a printed circuit board (PCB) with one or more electronic components mounted on its surface. Thus, the mounting substrate 10 may be provided with a circuit wiring to electrically connect electronic components to each other. Moreover, the mounting substrate 10 may be provided as a flexible substrate, a dielectric substrate, a glass substrate, or the like. The mounting substrate 10 may be composed of a plurality of layers. In detail, the mounting substrate 10 may be formed as a multilayer substrate formed by alternately stacking at least one insulating layer 17 and at least one wiring layer 16. At least one wiring layer 16 may include two outer layers provided on one surface and the other surface of the mounting substrate 10 and at least one inner layer provided between the two outer layers. As an example, the insulating layer 17 may be formed of an insulating material such as prepreg, an Ajinomoto build-up film (ABF), FR-4, or Bismaleimide Triazine (BT). The insulating layer may be formed using a thermosetting resin such as an epoxy resin, a thermoplastic resin such as a polyimide resin, a resin in which the thermosetting resin or the thermoplastic resin is impregnated together with an inorganic filler in a core material such as a glass fiber (or a glass cloth or a glass fabric). According to an embodiment, the insulating layer 17 may be formed using a photosensitive insulating resin.

The wiring layer 16 may be electrically connected to the electronic device 50, the plurality of chip antennas 100, and the plurality of end-fire antennas 200. The wiring layer 16 may include a conductive material such as copper (Cu), aluminum (Al), silver (Ag), tin (Sn), gold (Au), nickel (Ni), lead (Pb), titanium (Ti), or alloys thereof.

The wiring vias 18 for interconnection of the wiring layer 16 are disposed in the insulating layer 17. A wiring via 18, connected to a feed pad 16*a*, of the wiring vias 18 may be extended to pass through a ground layer 16*b* operated as a reflector. The wiring via 18, connected to the feed pad 16*a*, is extended to pass through the ground layer 16*b* and may be electrically connected to the electronic device 50 mounted on a component mounting surface of the mounting substrate 10.

The chip antenna 100 is mounted on one surface of the mounting substrate 10, specifically, on an upper surface of the mounting substrate 10. The chip antenna 100 may have a width extended in a Y-direction, a length extended in an X-direction, and a thickness extended in a Z-direction. The chip antenna 100, as illustrated in FIG. 1, may be arranged in an n×1 structure, where n is an integer. A plurality of chip antennas 100 may be arranged linearly in an X-axis direction. According to an embodiment, the plurality of chip antennas 100 are arranged in the X-axis direction and the Y-axis direction, and the plurality of chip antennas 100 may be arranged in an n×m structure.

A feed pad 16*a* providing an RF signal to the chip antenna 100 may be provided on an upper surface of the mounting substrate 10. A ground layer 16*b* may be disposed on any one inner layer among the plurality of layers of the mounting substrate 10. As an example, the wiring layer 16 disposed in a lower layer, which is the most adjacent to an upper surface of the mounting substrate 10, is used as a ground layer 16*b*. The ground layer 16*b* may be operated as a reflector of the chip antenna 100. Thus, the ground layer 16*b* may concentrate an RF signal by reflecting the RF signal output by the chip antenna 100 in the Z-direction, corresponding to an aiming direction, and may thereby improve gain.

In FIG. 2, the ground layer 16*b* is depicted disposed on a lower layer, which is the most adjacent layer to an upper surface of the mounting substrate 10. However, according to another embodiment, the ground layer 16*b* may be disposed on an upper surface of the mounting substrate 10 or on another layer.

A top pad 16*c*, bonded to the chip antenna 100, is disposed on an upper surface of the mounting substrate 10. The electronic device 50 may be mounted on the other side of the mounting substrate 10, specifically, in a lower surface thereof. A bottom pad 16*d*, electrically connected to the electronic device 50, is disposed on a lower surface of the mounting substrate 10.

An insulating protective layer 19 may be disposed on the lower surface of the mounting substrate 10. The insulating protective layer 19 is disposed as a cover for the insulating layer 17 and the wiring layer 16 mounted on a lower surface of the mounting substrate 10 to protect the wiring layer 16. As an example, the insulating protective layer 19 may include an insulating resin and an inorganic filler. The insulating protective layer 19 may have an opening exposing at least a portion of the wiring layer 16. Through a solder ball disposed in the opening, the electronic device 50 may be mounted on the bottom pad 16*d*.

Referring to FIG. 3A, the chip antenna module 1 may further include at least one end-fire antenna 200. Each end-fire antenna 200 may include an end-fire antenna pattern 210, a director pattern 215, and an end-fire feedline 220.

The end-fire antenna pattern 210 may transmit or receive an RF signal in a side surface direction. The end-fire antenna pattern 210 may be disposed on a side surface of the mounting substrate 10 and may be provided as a dipole or folded dipole. The director pattern 215 may be electromagnetically coupled to an end-fire antenna pattern 210 to improve the gain or bandwidth of the plurality of end-fire antenna patterns 210. The end-fire feedline 220 may transmit the RF signal, received by the end-fire antenna pattern 210 to the electronic device or an integrated circuit (IC), and may transmit the RF signal transmitted by the electronic device or IC, to the end-fire antenna pattern 210.

The end-fire antenna 200, formed by a wiring pattern of FIG. 3A may be implemented as an end-fire antenna 200 in the form of a chip, as illustrated in FIG. 3B.

Referring to FIG. 3B, each end-fire antenna 200 includes a body portion 230, a radiating unit 240, and a grounding unit 250. The body portion 230 has a hexahedral shape and is formed of a dielectric substance. For example, the body portion 230 may be formed of a polymer or a ceramic sintered body, having predetermined permittivity.

The radiating unit 240 is bonded to a first surface of the body portion 230, and the grounding unit 250 is bonded to a second surface opposite to the first surface of the body portion 230. The radiating unit 240 and the grounding unit 250 may be formed of the same material. The radiating unit 240 and the grounding unit 250 may be formed from any one or any combination of any two or more of Ag, Au, Cu, Al, Pt, Ti, Mo, Ni, and W. The radiating unit 240 and the grounding unit 250 may be formed to have the same shape or the same structure. The radiating unit 240 and the grounding unit 250 may be divided according to the type of the pad to be bonded when mounted on the mounting substrate 10. As an example, a portion bonded to a feed pad may function as the radiating unit 240, and a portion bonded to a ground pad may function as the grounding unit 250.

The end-fire antenna 200 formed as a chip has capacitance due to a dielectric substance between the radiating unit 240 and the grounding unit 250, and as such a coupling antenna is designed or its resonant frequency is tuned using the capacitance.

Typically, in order to achieve sufficient antenna characteristics for a patch antenna implemented as a pattern inside a multilayer board, multiple layers were required in a substrate. However, the multiple layers undesirably increased the volume of the patch antenna excessively. The attendant problem was solved by a method in which an insulator having high permittivity and reduced thickness was disposed inside a multilayer board to reduce the size and thickness of the antenna pattern.

However, if permittivity of the insulator is increased, the wavelength of a corresponding RF signal is shortened, so the RF signal is blocked by the high permittivity insulator. Thus, a problem occurs in which the radiation efficiency and gain of the RF signal are significantly reduced.

According to an embodiment of the present disclosure, a patch antenna, which was implemented as a pattern in a multilayer board in the related art, may be implemented as a chip, so as to significantly reduce the number of layers of the substrate having the chip antenna mounted thereon. Thus, the manufacturing costs and volume of the chip antenna module 1 in an embodiment could be reduced.

In addition, according to an embodiment of the present disclosure, permittivity of dielectric substrates, disposed on the chip antenna 100, is formed higher than the permittivity of the insulating layer disposed on the mounting substrate 10, so as to miniaturize the chip antenna 100.

Furthermore, dielectric substrates of the chip antenna 100 are spaced apart from each other by a predetermined distance, or a material having permittivity lower than that of dielectric substrates is disposed between the dielectric substrates so as to reduce the overall permittivity of the chip antenna 100. Thus, while the chip antenna 100 is miniaturized, the wavelength of a corresponding RF signal may be increased so as to improve the radiation efficiency and gain. Here, the overall permittivity of the chip antenna 100 may be understood as permittivity formed by dielectric substrates of the chip antenna 100 and a gap between the dielectric substrates or permittivity formed by dielectric substrates of the chip antenna 100 and a material disposed between the dielectric substrates. Thus, when dielectric substrates of the chip antenna 100 are spaced apart from each other by a predetermined distance, or a material having permittivity lower than that of dielectric substrates is disposed between the dielectric substrates, the overall permittivity of the chip antenna 100 may be lower than the permittivity of dielectric substrates.

Figure 4A:
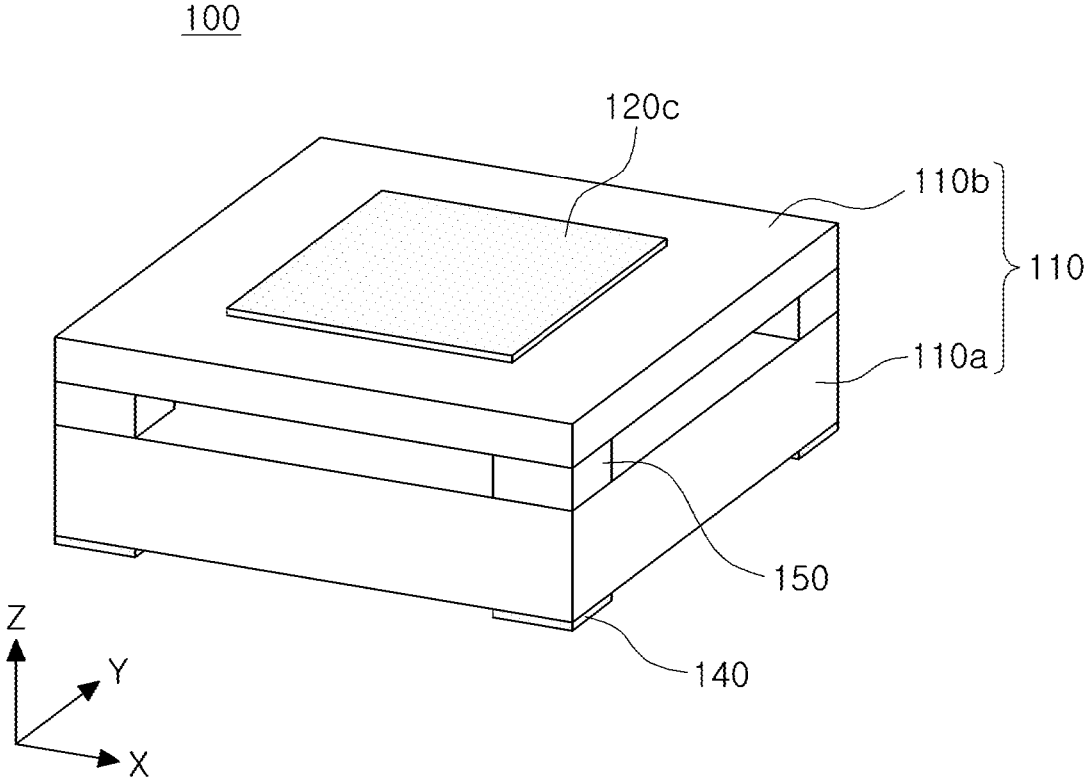
FIG. 4A is a perspective view of a chip antenna according to a first embodiment of the present disclosure.
Figure 4B:
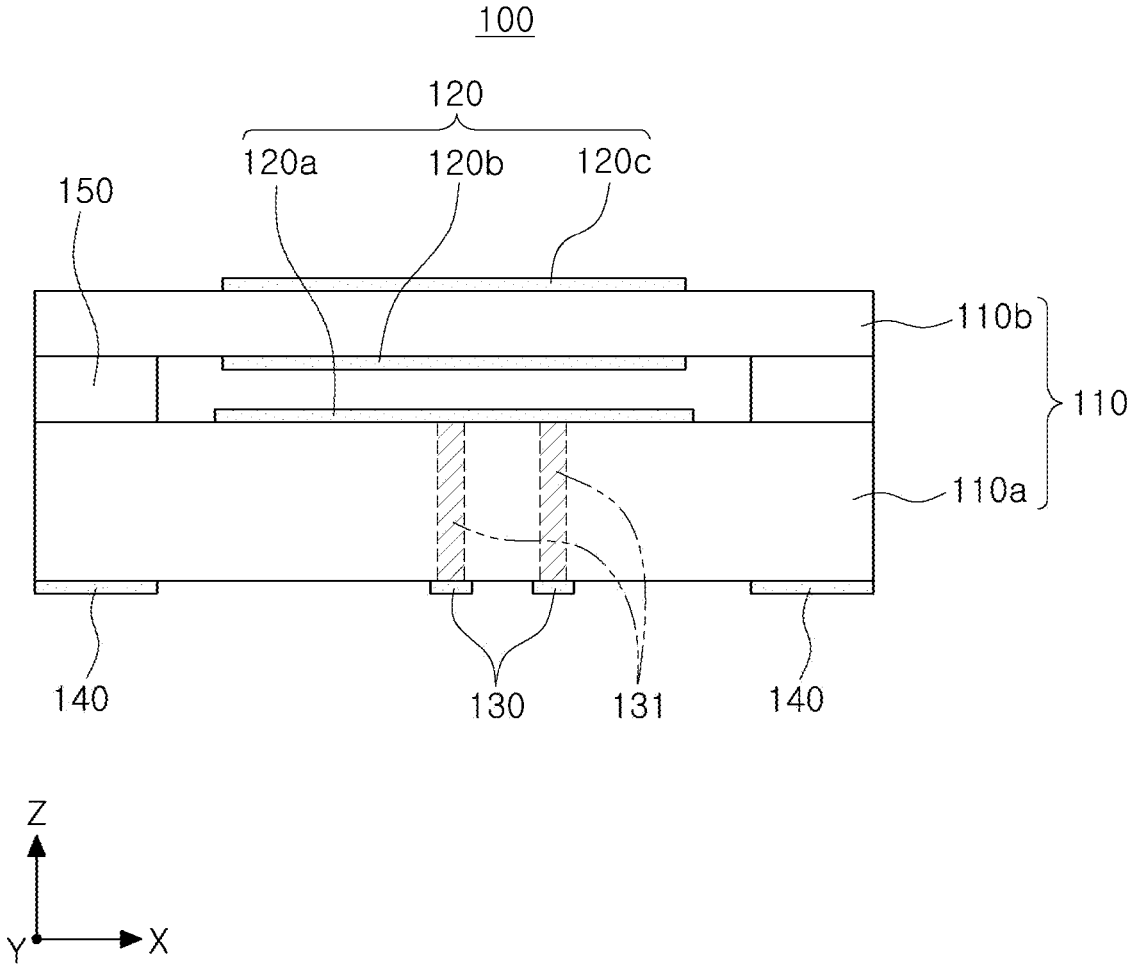
FIG. 4B is a cross-sectional view of the chip antenna of FIG. 4A.

FIG. 4A is a perspective view of a chip antenna according to a first embodiment of the present disclosure. FIG. 4B is a cross-sectional view of the chip antenna of FIG. 4A, and FIG. 4C is a bottom view of the chip antenna of FIG. 4A.

Figure 4C:
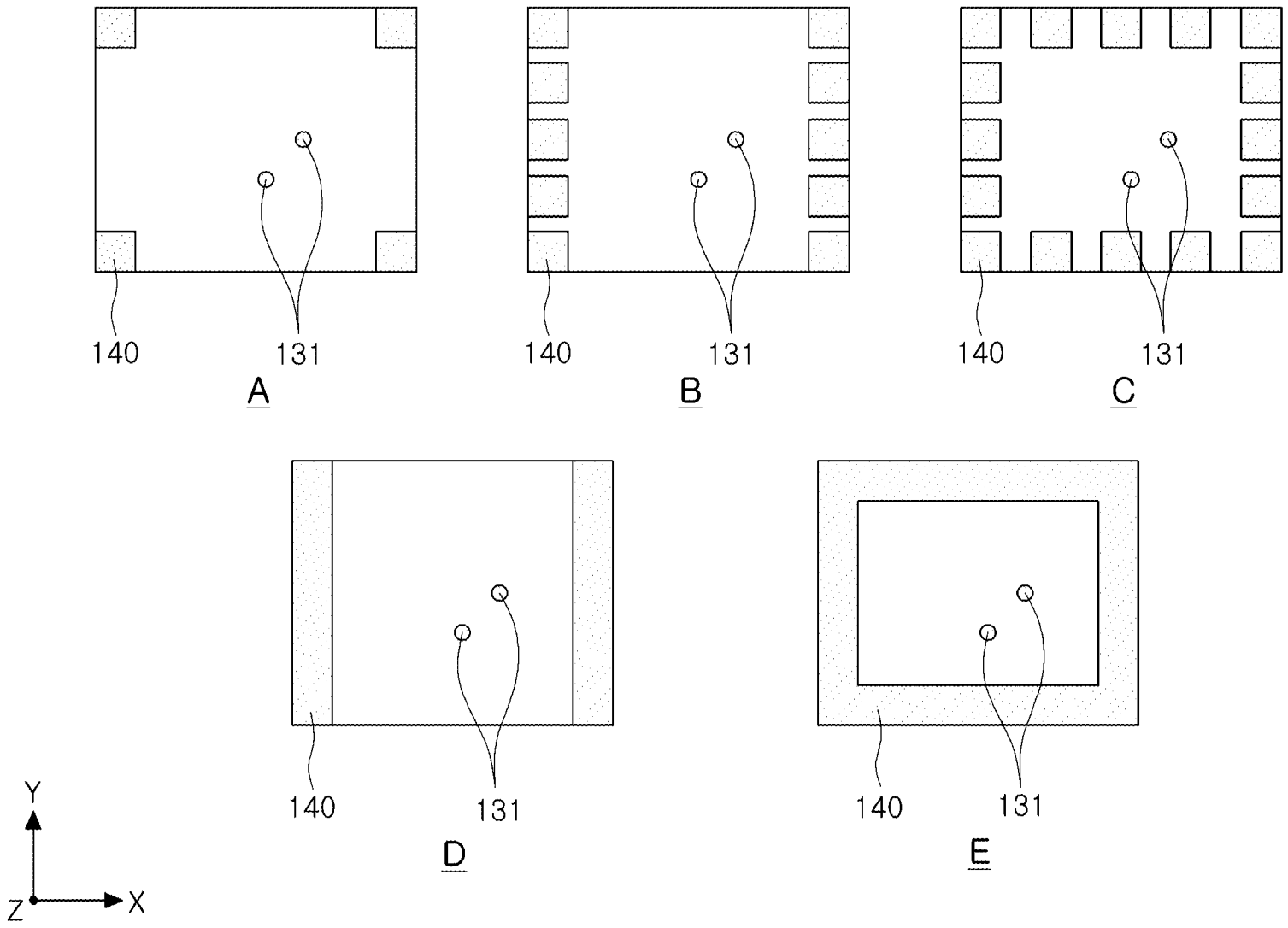
FIG. 4C is a bottom view of the chip antenna of FIG. 4A.

Referring to FIGS. 4A, 4B, and 4C, a chip antenna 100 according to a first embodiment of the present disclosure, may include a dielectric substrate portion 110 and a patch portion 120. The dielectric substrate portion 110 includes a first dielectric substrate 110*a*, and a second dielectric substrate 110*b*. The patch portion 120 includes a first patch 120*a*, and may include at least one of a second patch 120*b* and a third patch 120*c*. As an example, the first patch 120*a*, the second patch 120*b*, and the third patch 120*c* may be formed to have thicknesses of 20 μm.

The first patch 120*a* may be formed of metal as a flat plate having a constant area. As an example, the first patch 120*a* may have a quadrangular shape. However, according to an embodiment, the first patch may have various shapes such as a polygonal shape, a circular shape, and the like. The first patch 120*a* is connected to the feed via 131, and thus may function and be operated as a feed patch.

The second patch 120*b* and the third patch 120*c* are spaced apart from the first patch 120*a* by a predetermined distance and may be formed of metal in the form of a flat plate having a constant area. The second patch 120*b* and the third patch 120*c* may have an area the same as or different from that of the first patch 120*a*. As an example, the second patch 120*b* and the third patch 120*c* may be formed to have an area smaller than the first patch 120*a* and may be disposed in an upper portion of the first patch 120*a*. As an example, the second patch 120*b* and the third patch 120*c* may be formed to be smaller than the first patch 120*a* by 5% to 8%.

The first patch 120*a*, the second patch 120*b*, and the third patch 120*c* are formed to have the same or a similar area. The first patch 120*a*, the second patch 120*b*, and the third patch 120*c* are overlapped in a vertical direction (a Z-axis direction).

The second patch 120*b* and the third patch 120*c* may be electromagnetically coupled with the first patch 120*a*, and thus may function and be operated as a radiation patch. The second patch 120*b* and the third patch 120*c* may further concentrate an RF signal in a Z-direction corresponding to a mounting direction of the chip antenna 100 and thus may improve the gain or bandwidth of the first patch 120*a*. The chip antenna 100 may include at least one of the second patch 120*b* and the third patch 120*c*, functioning as a radiation patch.

The first patch 120*a*, the second patch 120*b*, and the third patch 120*c* may be formed of any one or any two or more of any combination of Ag, Au, Cu, Al, Pt, Ti, Mo, Ni, and W. Moreover, the first patch 120*a*, the second patch 120*b*, and the third patch 120*c* may be formed of a conductive paste or conductive epoxy.

According to an embodiment, on the first patch 120*a*, the second patch 120*b*, and the third patch 120*c*, a plating layer formed as a film may be additionally formed along a surface of each of the first patch 120*a*, the second patch 120*b*, and the third patch 120*c*. The plating layer may be formed on a surface of each of the first patch 120*a*, the second patch 120*b*, and the third patch 120*c* through a plating process. The plating layer may be formed by sequentially stacking a nickel (Ni) layer and a tin (Sn) layer and may be formed by sequentially stacking a zinc (Zn) layer and a tin (Sn) layer.

Meanwhile, according to an embodiment, the plating layer may be formed of one type selected from copper (Cu), nickel (Ni), and tin (Sn), or formed of an alloy formed of two or more types selected therefrom.

The plating layer may be formed on each of the first patch 120*a*, the second patch 120*b*, and the third patch 120*c*, and may prevent oxidation of the first patch 120*a*, the second patch 120*b*, and the third patch 120*c*.

One of the first dielectric substrate 110*a* and the second dielectric substrate 110*b* may be formed of ceramic, while the other may be formed of polytetrafluoroethylene (PTFE). As an example, the first dielectric substrate 110*a* is formed of ceramic, while the second dielectric substrate 110*b* is formed of PTFE. As another example, the first dielectric substrate 110*a* is formed of PTFE, while the second dielectric substrate 110*b* is formed of ceramic.

The substrate, formed of ceramic, may be composed of a ceramic sintered body. The ceramic may contain magnesium (Mg), silicon (Si), aluminum (Al), calcium (Ca), and titanium (Ti). As an example, the ceramic may include $Mg_2SiO_4$, $MgAl_2O_4$, and $CaTiO_3$. As another example, the ceramic may further include $MgTiO_3$, in addition to $Mg_2SiO_4$, $MgAl_2O_4$, and $CaTiO_3$. According to an embodiment, $CaTiO_3$ is replaced with $MgTiO_3$, so the ceramic may include $Mg_2SiO_4$, $MgAl_2O_4$, and $MgTiO_3$.

The substrate, formed of PTFE, may have permittivity similar to that of the substrate formed of ceramic. As an example, the substrate, formed of PTFE, may have permittivity lower than that of the substrate, formed of ceramic. In detail, the substrate, formed of ceramic, may have permittivity of 3 to 4 at 28 GHz, while the substrate, formed of PTFE, may have permittivity of 2 to 3 at 28 GHz, and preferably, the permittivity of 2.4.

The PTFE may have robust characteristics against external impacts than the ceramic. In detail, the tensile strength of ceramic is 69 $kg/cm^2$, and the compressive strength thereof is 690 $kg/cm^2$; however, the tensile strength of the PTFE is 140 to 350 $kg/cm^2$ and the compressive strength thereof is 120 $kg/cm^2$. Here, the PTFE is more robust against compression or tensile caused by external impacts, as compared with the ceramic. The melting temperature of the ceramic is about 2000 degrees, while the melting temperature of the PTFE is about 260 degrees. Thus, the ceramic has more excellent thermal stability, as compared with the PTFE.

Thus, in the chip antenna, according to an embodiment of the present disclosure, one substrate, requiring a soldering process, of the first dielectric substrate 110*a* and the second dielectric substrate 110*b* is formed of ceramic while the other substrate is formed of PTFE. Thus, thermal stability is achieved, while durability and brittleness are improved, so the overall reliability may be significantly improved.

A first patch 120*a* is disposed on one surface of the first dielectric substrate 110*a*, while a feed pad 130 is disposed on the other surface of the first dielectric substrate 110*a*. At least one feed pad 130 may be disposed on the other surface of the first dielectric substrate 110*a*. A thickness of the feed pad 130 may be 20 μm.

The feed pad 130, disposed on the other surface of the first dielectric substrate 110*a*, may be electrically connected to the feed pad 16*a*, disposed on one surface of the mounting substrate 10. The feed pad 130 is electrically connected to the feed via 131 passing through the first dielectric substrate 110*a* in a thickness direction, and the feed via 131 is connected to the first patch 110*a*, disposed on one surface of the first dielectric substrate 110*a*, and may provide an RF signal or receive an RF signal, received by the first patch 110*a*.

At least one feed via 131 may be provided. As an example, two feed vias 131 may be provided to correspond to two feed pads 130. One feed via 131, of two feed vias 131, may correspond to a feed line for generating vertical polarization, while the other feed via 131 may correspond to a feed line for generating horizontal polarization. As an example, a diameter of the feed via 131 may be 150 μm.

A mounting pad 140 is disposed on the other surface of the first dielectric substrate 110*a*. The first dielectric substrate 110*a* may be mounted on the mounting substrate 10, through the mounting pad 140. The other surface of the first dielectric substrate 110*a*, having the mounting pad 140 disposed thereon, may be understood as a mounting surface of the first dielectric substrate 110*a*. The mounting pad 140, disposed on the other surface of the first dielectric substrate 110*a*, may be bonded to a top pad 16*c* disposed on one surface of the mounting substrate 10. As an example, the mounting pad 140 of the chip antenna 100 may be bonded to the top pad 16*c* of the mounting substrate 10, through a solder paste. A thickness of the mounting pad 140 may be 20 μm.

Referring to A of FIG. 4C, a mounting pad 140 is provided as a plurality of mounting pads, and the mounting pads may be disposed on each edge of a quadrangular shape, on the other surface of the first dielectric substrate 110*a*.

In addition, referring to B of FIG. 4C, a plurality of mounting pads 140 may be provided to be spaced apart from each other by a predetermined distance, along each of one side and the other side, opposite to one side, of a quadrangular shape, on the other surface of the first dielectric substrate 110*a*.

In addition, referring to C of FIG. 4C, a plurality of mounting pads 140 may be provided to be spaced apart from each other by a predetermined distance, along each of four sides of a quadrangular shape, on the other surface of the first dielectric substrate 110*a*.

In addition, referring to D of FIG. 4C, the mounting pads 140 may be provided to have a shape with a length corresponding to one side and the other side, along each of one side and the other side, opposite to one side, of a quadrangular shape, on the other surface of the first dielectric substrate 110*a*.

Moreover, referring to E of FIG. 4C, the mounting pads 140 may be provided to have a shape with a length corresponding to four sides, along each of four sides of a quadrangular shape, on the other surface of the first dielectric substrate 110*a*.

In A, B, and C of FIG. 4C, it is illustrated that the mounting pad 140 has a quadrangular shape, however the mounting pad 140 may have various other shapes such as a circle, or the like, according to an embodiment. In addition, in A, B, C, D, and E of FIG. 4C, it is illustrated that the mounting pads 140 are disposed adjacent to four sides of a quadrangular shape, however, the mounting pads 140 may be disposed to be spaced apart from four sides by a predetermined distance, according to an embodiment.

The second dielectric substrate 110*b* may have a thickness less than that of the first dielectric substrate 110*a*. According to an embodiment, the second dielectric substrate 110*b* may have a thickness equal to that of the first dielectric substrate 110*a*. As an example, a thickness of the first dielectric substrate 110*a* may correspond to 1 to 5 times a thickness of the second dielectric substrate 110*b*, and preferably may correspond to 2 to 3 times the thickness thereof. As an example, the thickness of the first dielectric substrate 110*a* may be 150 μm to 500 μm, and the thickness of the second dielectric substrate 110*b* may be 100 μm to 200 μm. Preferably, the thickness of the second dielectric substrate 110*b* may be 50 μm to 200 μm.

According to an embodiment of the present disclosure, according to a thickness of the second dielectric substrate 110*b*, an appropriate distance between the first patch 120*a* and the second patch 120*b*/and the third patch 120*c* is maintained, so the radiation efficiency of an RF signal may be improved.

The permittivity of the first dielectric substrate 110*a* and the second dielectric substrate 110*b* may be higher than the permittivity of the mounting substrate 10, specifically, the permittivity of the insulating layer 17 disposed on the mounting substrate 10. Thus, a volume of a chip antenna is reduced, so the entire chip antenna module could be miniaturized.

A second patch 120*b* is disposed on the other surface of the second dielectric substrate 110*b*, while a third patch 120*c* is disposed on one surface of the second dielectric substrate 110*b*.

The first dielectric substrate 110*a* and the second dielectric substrate 110*b* may be spaced apart from each other by the spacer 150. The spacer 150 may be disposed on each edge of a quadrangular shape of the first dielectric substrate 110*a*/the second dielectric substrate 110*b*, between the first dielectric substrate 110*a* and the second dielectric substrate 110*b*. Moreover, according to an embodiment, the spacer 150 may be provided on two sides, one side and the other side, opposing one side, of a quadrangular shape of the first dielectric substrate 110*a*/the second dielectric substrate 110*b*. Due to the spacer 150, a gap may be provided between the first patch 120*a*, disposed on one surface of the first dielectric substrate 110*a*, and the second patch 120*b*, disposed on the other surface of the second dielectric substrate 110*b*. In a space formed by the gap, as air having permittivity of 1 is filled therein, overall permittivity of the chip antenna 100 may be lowered.

According to an embodiment of the present disclosure, the first dielectric substrate 110*a* and the second dielectric substrate 110*b* are formed of a material having permittivity higher than permittivity of the mounting substrate 10 so that the chip antenna module could be miniaturized. Moreover, a gap is provided between the first dielectric substrate 110*a* and the second dielectric substrate 110*b*, so that the overall permittivity of the chip antenna 100 is lowered. Thus, the radiation efficiency and gain may be improved.

Figure 5A:
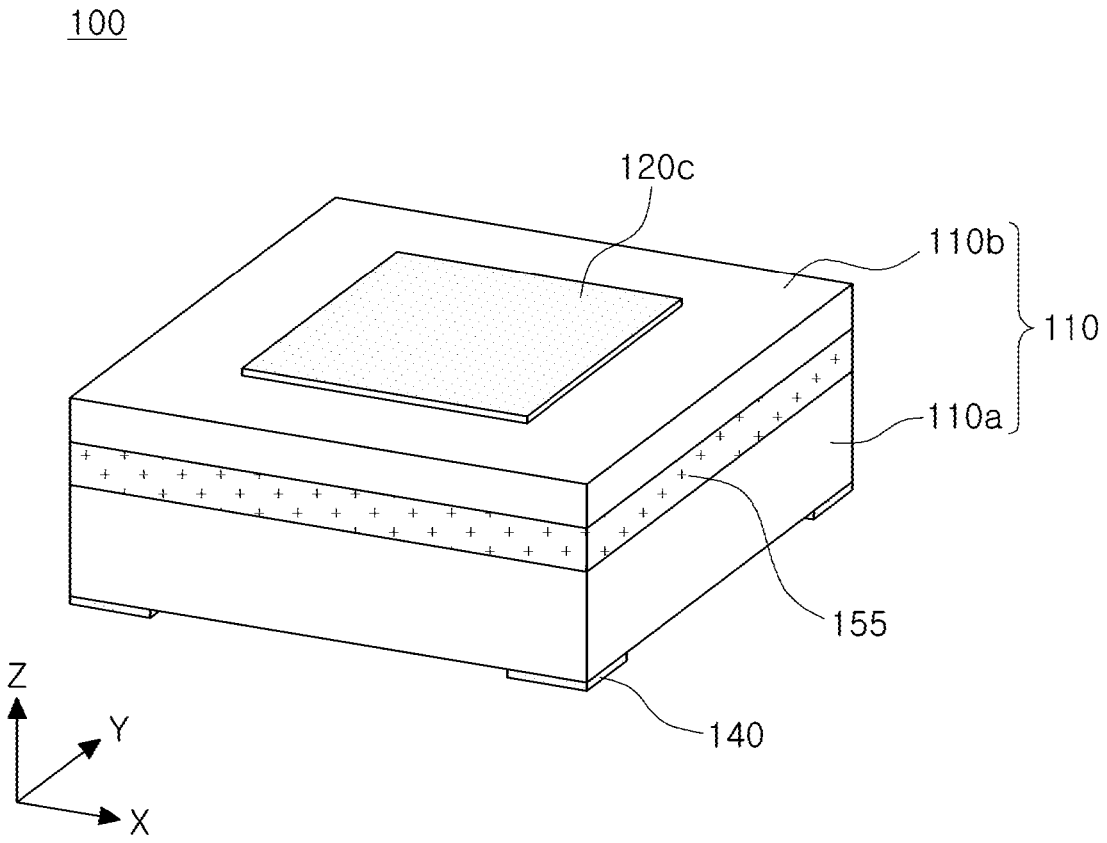
FIG. 5A is a perspective view of a chip antenna according to a second embodiment of the present disclosure.
Figure 5B:
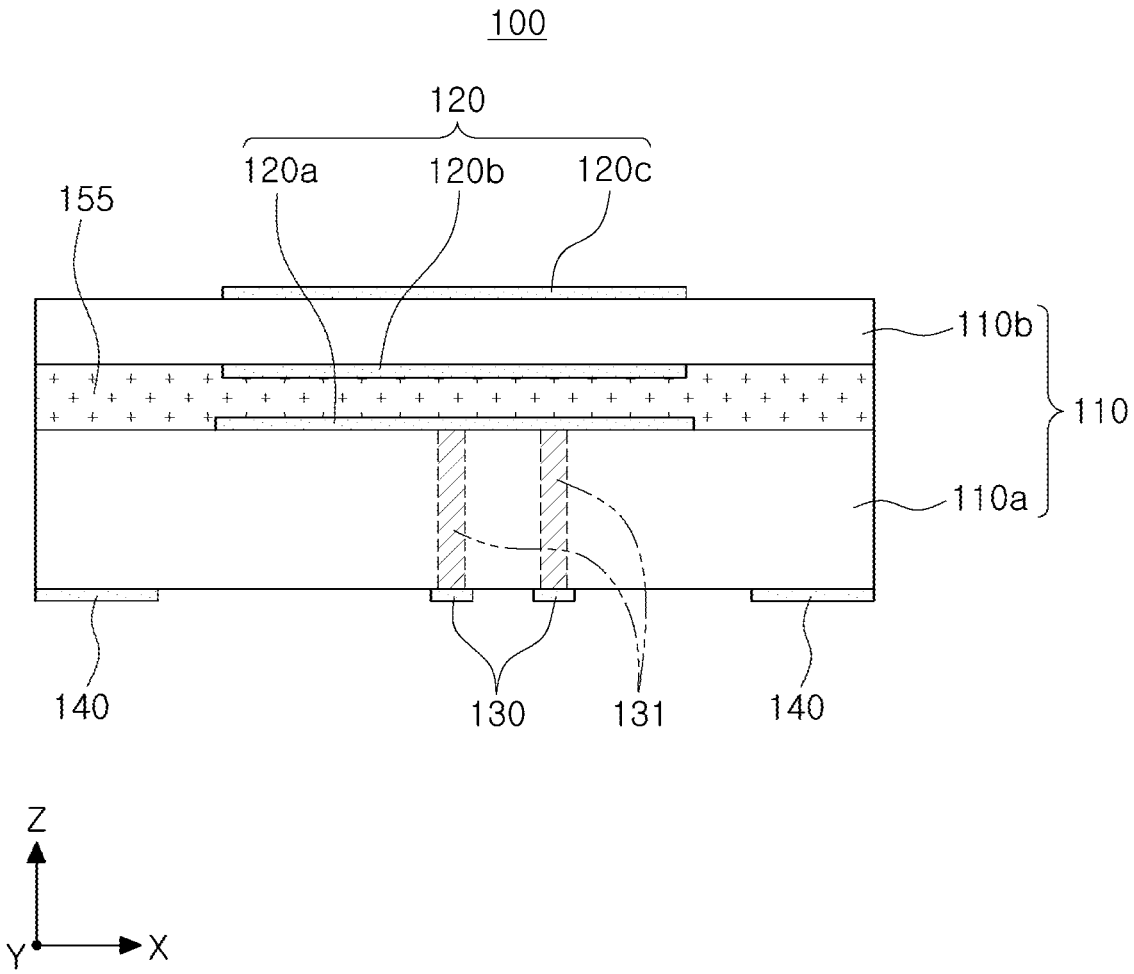
FIG. 5B is a cross-sectional view of the chip antenna of FIG. 5A.

FIG. 5A is a perspective view of a chip antenna according to a second embodiment of the present disclosure, and FIG. 5B is a cross-sectional view of the chip antenna of FIG. 5A. The chip antenna according to the second embodiment is similar to the chip antenna according to the first embodiment, so duplicate descriptions are omitted and the differences will be mainly explained.

The first dielectric substrate 110*a* and the second dielectric substrate 110*b* of the chip antenna 100, according to a first embodiment, are spaced apart from each other by a spacer 150. As compared with the chip antenna of a first embodiment, a first dielectric substrate 110*a* and a second dielectric substrate 110*b* of a chip antenna 100 according to a second embodiment may be bonded to each other by a bonding layer 155 disposed between the first dielectric substrate 110*a* and the second dielectric substrate 110*b*.

The bonding layer 155 is formed to cover one surface of the first dielectric substrate 110*a* and the other surface of the second dielectric substrate 110*b*, and thus may bond the entirety of the first dielectric substrate 110*a* and the second dielectric substrate 110*b*. The bonding layer 155 may be formed of, for example, a polymer. As an example, the polymer may include a polymer sheet. The permittivity of the bonding layer 155 may be lower than the permittivity of the first dielectric substrate 110*a* and the second dielectric substrate 110*b*. As an example, the permittivity of the bonding layer 155 is 2 to 3 at 28 GHz, while a thickness of the bonding layer 155 may be 50 μm to 200 μm.

According to an embodiment of the present disclosure, while the first dielectric substrate 110*a* and the second dielectric substrate 110*b* are formed of a material having permittivity higher than permittivity of the mounting substrate 10 to miniaturize a chip antenna module, a material having permittivity lower than that of the first dielectric substrate 110*a* and the second dielectric substrate 110*b* is provided between the first dielectric substrate 110*a* and the second dielectric substrate 110*b*. Thus, the overall permittivity of the chip antenna 100 is lowered, so the radiation efficiency and gain may be improved.

Figure 6A:
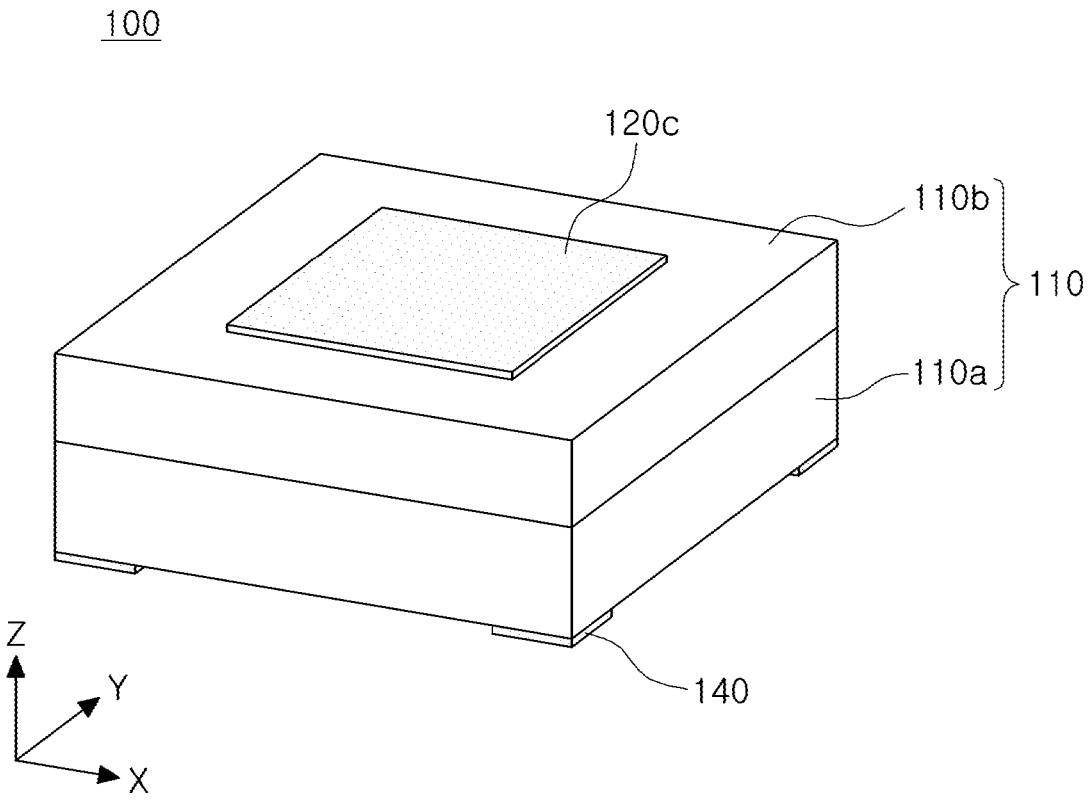
FIG. 6A is a perspective view of a chip antenna according to a third embodiment of the present disclosure.
Figure 6B:
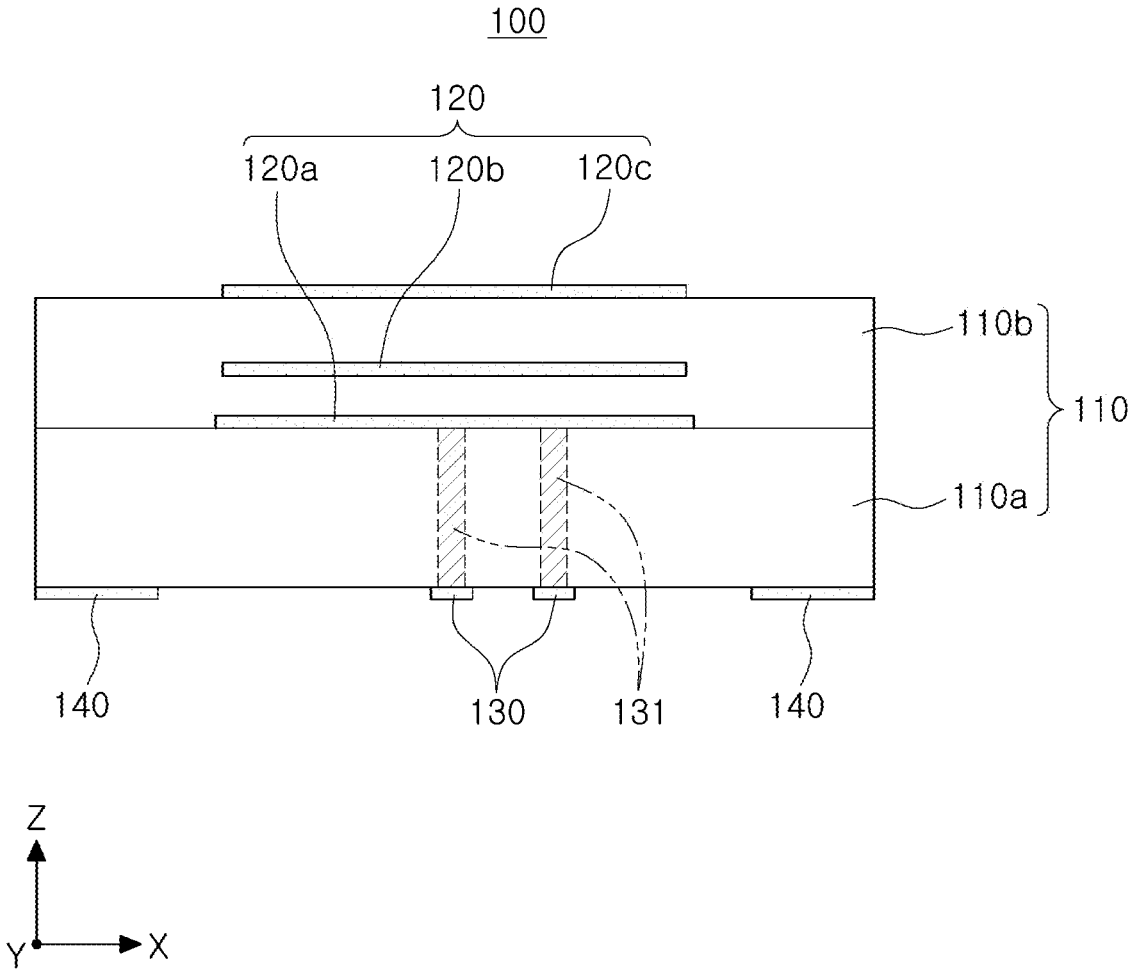
FIG. 6B is a cross-sectional view of the chip antenna of FIG. 6A.
Figure 7A:
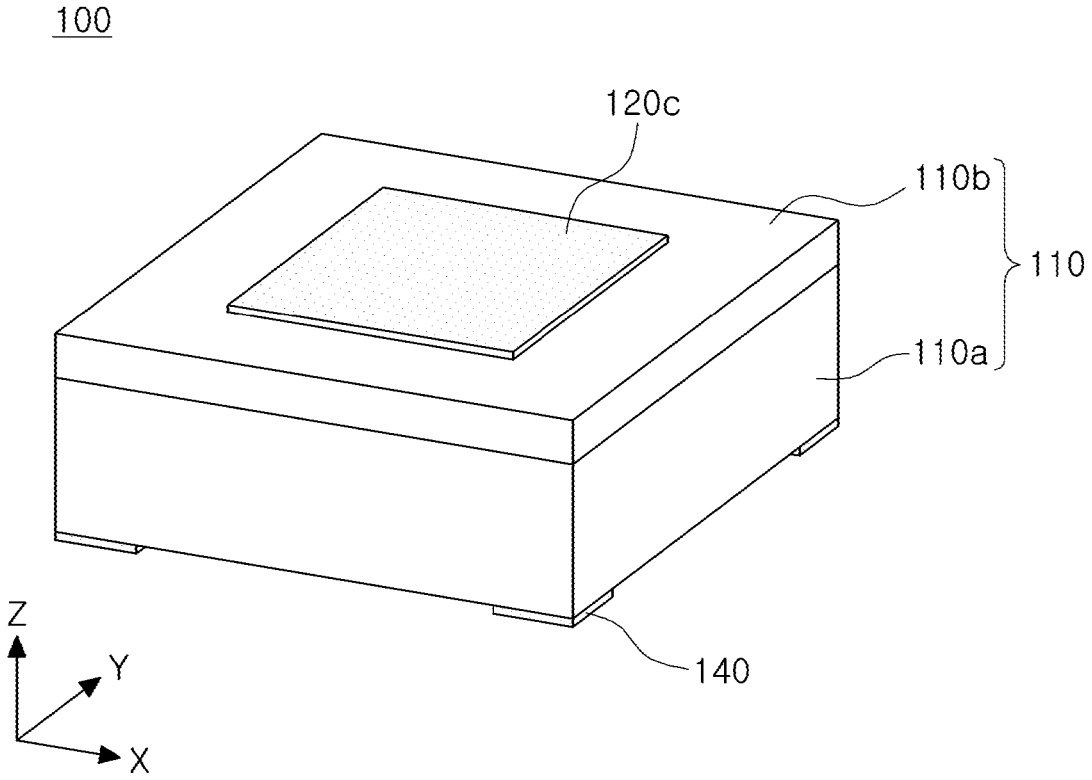
FIG. 7A is a perspective view of a chip antenna according to a fourth embodiment of the present disclosure.
Figure 7B:
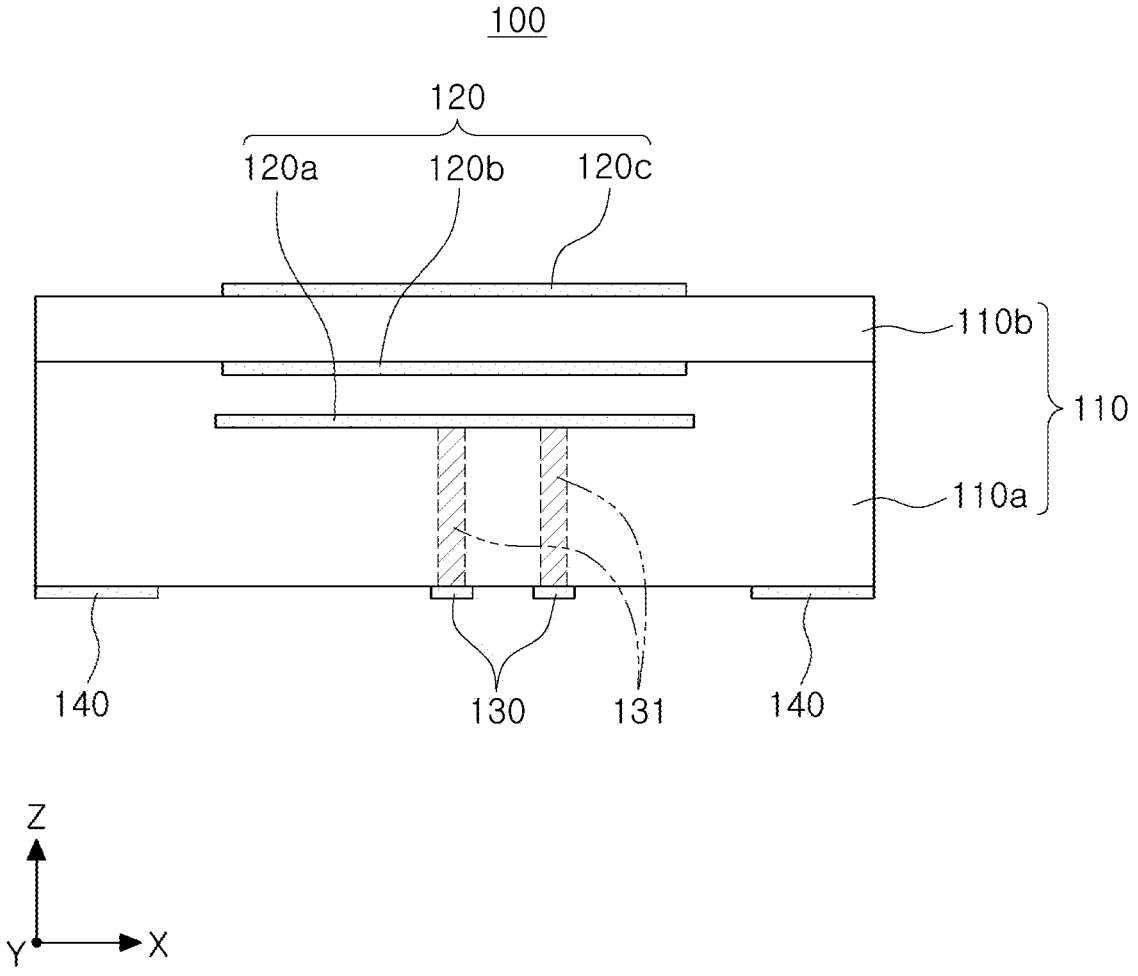
FIG. 7B is a cross-sectional view of the chip antenna of FIG. 7A.

FIG. 6A is a perspective view of a chip antenna according to a third embodiment of the present disclosure, and FIG. 6B is a cross-sectional view of the chip antenna of FIG. 6A. FIG. 7A is a perspective view of a chip antenna according to a fourth embodiment of the present disclosure, and FIG. 7B is a cross-sectional view of the chip antenna of FIG. 7A.

The chip antenna, according to each of the third embodiment and the fourth embodiment is similar to the chip antenna according to the first embodiment, so duplicate descriptions are omitted and the differences will be mainly explained.

Referring to FIGS. 6A and 6B, the first dielectric substrate 110*a* and the second dielectric substrate 110*b* are directly bonded to each other. The first patch 120*a* is provided on one surface of the first dielectric substrate 110*a* and may be formed to have a shape protruding toward the second dielectric substrate 110*b*. The second patch 120*b* may be formed to have a shape embedded inside the second dielectric substrate 110*b*, while the third patch 120*c* may be provided on one surface of the second dielectric substrate 110*b*.

When the chip antenna 100 according to a first embodiment and the chip antenna 100 according to a third embodiment are compared with each other, the sum of a thickness of the second dielectric substrate 110*b* and a thickness of the spacer 150, according to a first embodiment, may correspond to a thickness of the second dielectric substrate 110*b* according to a third embodiment. That is, the thickness of the second dielectric substrate 110*b* according to a third embodiment may be understood to be extended by an amount equal to the thickness of the spacer 150 of the chip antenna 100 according to a first embodiment, as compared with the thickness of the second dielectric substrate 110*b* according to a first embodiment.

Referring to FIGS. 7A and 7B, the first dielectric substrate 110*a* and the second dielectric substrate 110*b* are directly bonded to each other. The first patch 120*a* may be formed to have a shape embedded inside the first dielectric substrate 110*a*, while the second patch 120*b* may be provided on the other surface of the second dielectric substrate 110*b*, and may be formed to have a shape protruding toward the first dielectric substrate 110*a*. The third patch 120*c* may be provided on one surface of the second dielectric substrate 110*b*.

When the chip antenna 100 according to a first embodiment and the chip antenna 100 according to a fourth embodiment are compared with each other, the sum of a thickness of the first dielectric substrate 110*a* and a thickness of the spacer 150, according to a first embodiment, may correspond to a thickness of the first dielectric substrate 110*a* according to a fourth embodiment. That is, the thickness of the first dielectric substrate 110*a* according to a fourth embodiment may be understood to be extended by an amount equal to the thickness of the spacer 150 of the chip antenna 100 according to a first embodiment, as compared with the thickness of the first dielectric substrate 110*a* according to a first embodiment.

In the chip antenna according to the third embodiment and the chip antenna according to the fourth embodiment, a dielectric substrate, having a patch embedded therein, of the first dielectric substrate 110*a* and the second dielectric substrate 110*b*, is formed of PTFE, while a remaining substrate may be formed of ceramic.

In detail, in a third embodiment, the first dielectric substrate 110*a* is formed of ceramic, while the second dielectric substrate 110*b* is formed of PTFE. In a fourth embodiment, the first dielectric substrate 110*a* is formed of PTFE, while the second dielectric substrate 110*b* is formed of ceramic.

According to an embodiment of the present disclosure, a substrate, formed of PTFE having permittivity lower than the permittivity of ceramic, is replaced with a region having low permittivity due to a gap formed by a spacer according to a first embodiment or a bonding layer according to a second embodiment. Thus, while the radiation efficiency and gain of the chip antenna 100 are improved, durability and brittleness may be significantly improved.

Figure 8A:
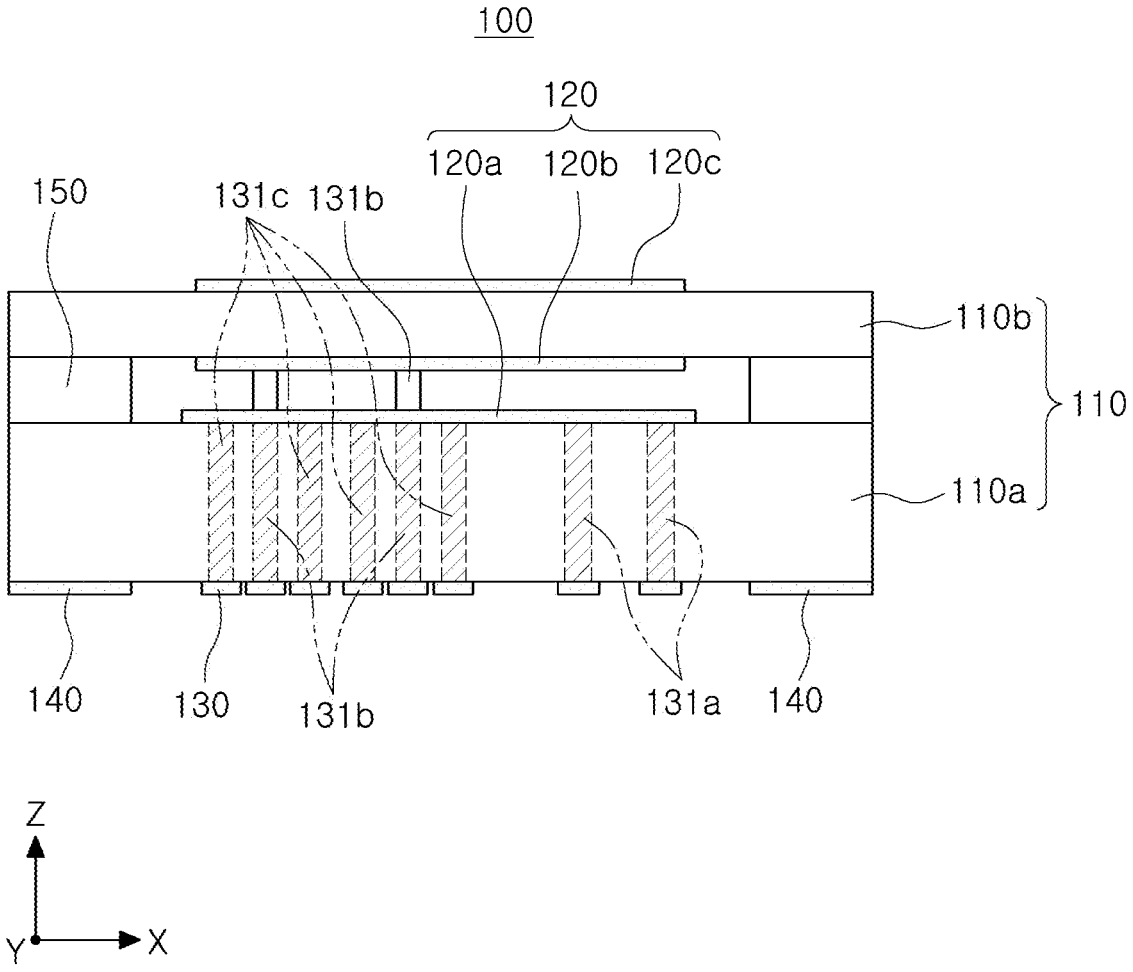
FIG. 8A is a cross-sectional view illustrating a chip antenna for a dual band according to an embodiment of the present disclosure.
Figure 8B:
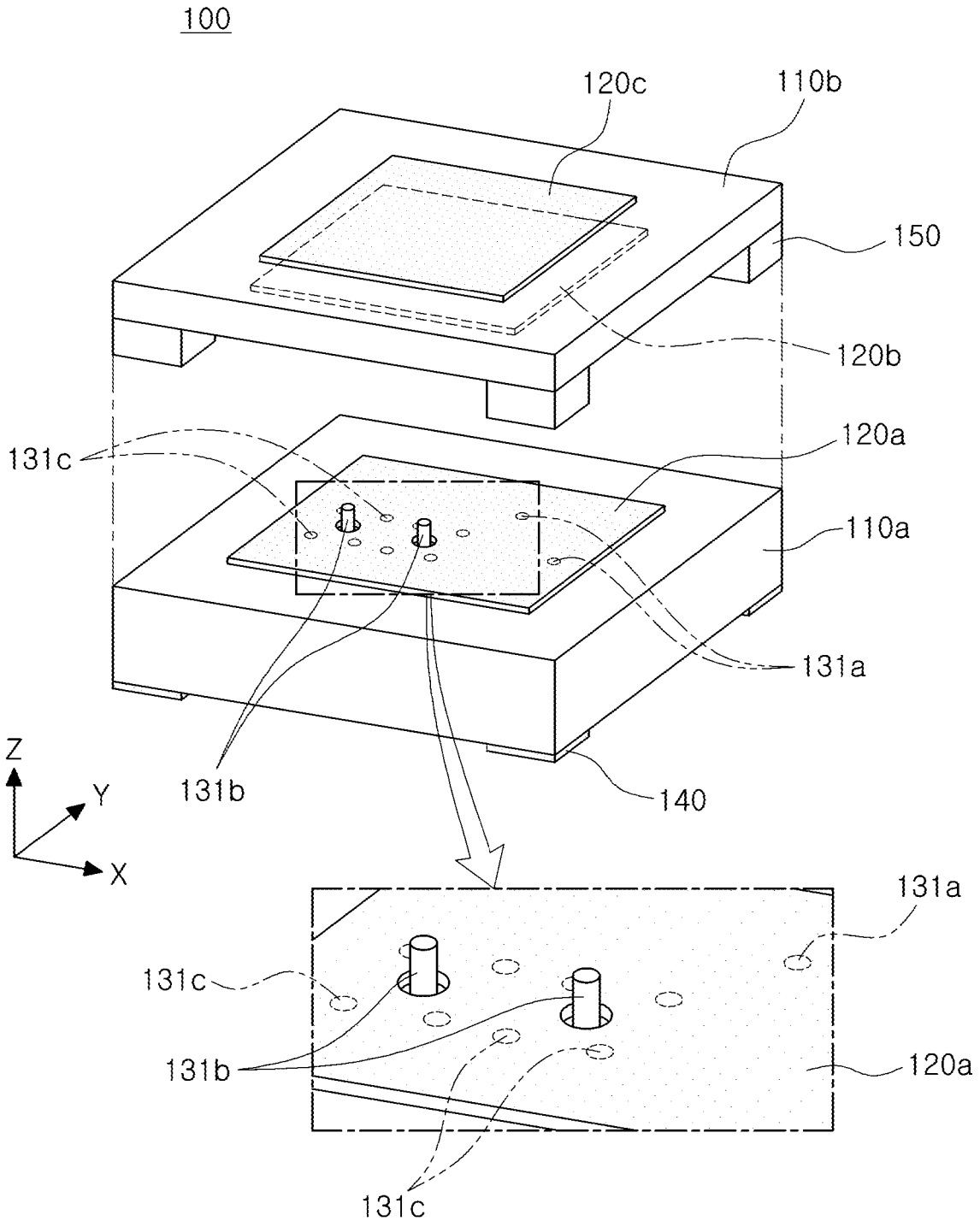
FIG. 8B is an exploded perspective view of the chip antenna for a dual band according to an embodiment of FIG. 8A viewed from above.
Figure 8C:
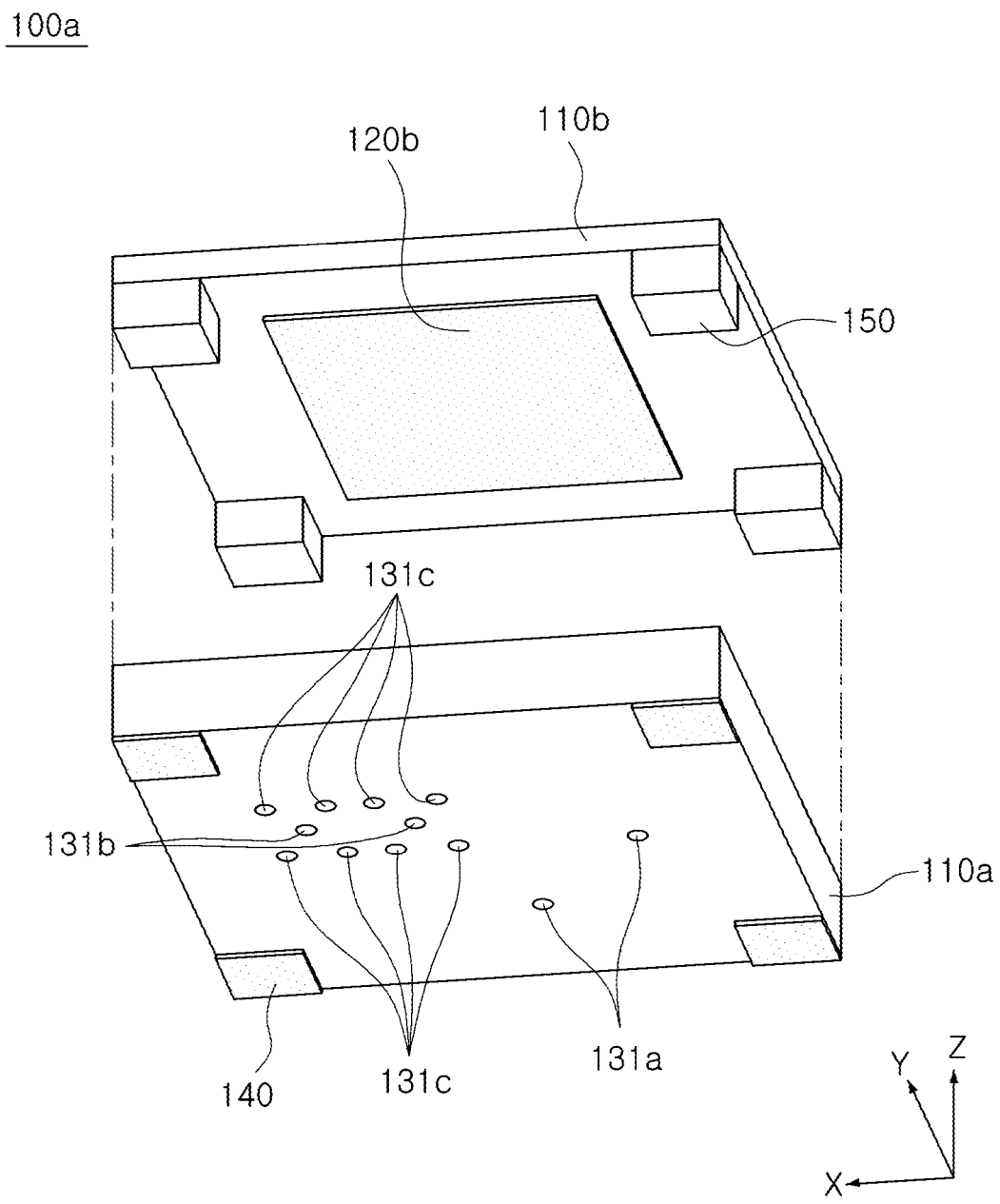
FIG. 8C is an exploded perspective view of the chip antenna for a dual band according to an embodiment of FIG. 8A viewed from below.

FIG. 8A is a cross-sectional view of a chip antenna for a dual band according to an embodiment of the present disclosure. FIG. 8B is an exploded perspective view of the chip antenna for a dual band according to an embodiment of FIG. 8A viewed from above. FIG. 8C is an exploded perspective view of the chip antenna for a dual band according to an embodiment of FIG. 8A viewed from below.

The chip antenna for a dual band 100, according to an embodiment, is similar to the chip antenna according to the first embodiment, so duplicate descriptions are omitted and the differences will be mainly explained.

In a first embodiment, it is described that at least one of the second patch 120*b* and the third patch 120*c* is disposed on the patch portion 120. However, in an embodiment, in order to implement a dual band, the patch portion 120 may essentially include the second patch 120*b* and may optionally include the third patch 120*c*.

Referring to FIGS. 8A, 8B, and 8C, a chip antenna 100 according to an embodiment of the present disclosure may further include a first feed via 131*a*, a second feed via 131*b*, and a plurality of shielding vias 131*c*.

The first patch 120*a* may be electrically connected to the first feed via 131*a*. The first feed via 131*a* is extended in a thickness direction of the first dielectric substrate 110*a* and may be connected to the first patch 120*a*. The first patch 120*a* may receive and transmit a first RF signal in a first frequency band from the first feed via 131*a* or may receive and provide the first RF signal to the first feed via 131*a*.

The second patch 120*b* may be electrically connected to the second feed via 131*b*. The second patch 120*b* may receive and transmit a second RF signal in a second frequency band from the second feed via 131*b* or may receive and provide the second RF signal to the second feed via 131*b*.

The first feed via 131*a* may include two feed vias. One feed via, of the two feed vias of the first feed via 131*a*, may correspond to a feed line for generating vertical polarization, while the other feed via may correspond to a feed line for generating horizontal polarization.

In a similar manner, the second feed via 131*b* may include two feed vias. One feed via, of the two feed vias of the second feed via 131*b*, may correspond to a feed line for generating vertical polarization, while the other feed via may correspond to a feed line for generating horizontal polarization.

The second patch 120*b* may be electrically connected to the second feed via 131*b*. The second feed via 131*b*, extended in a thickness direction of the first dielectric substrate 110*a*, may pass through the first patch 120*a* so that the second feed via 131*b* is electrically connected to the second patch 120*b*. Thus, even when a connection point of the second patch 120*b* and the second feed via 131*b* is overlapped with the first patch 120*a* in a vertical direction, the second patch 120*b* and the second feed via 131*b* may be easily connected to each other. To this end, a through-hole passing through the second feed via 131*b* may be provided in the first patch 120*a*. Accordingly, a connection point of the first patch 120*a* and the first feed via 131*a* and a connection point of the second patch 120*b* and the second feed via 131*b* may be designed freely.

The connection point of the first patch 120*a* and the first feed via 131*a* and the connection point of the second patch 120*b* and the second feed via 131*b* may affect transmission line impedance of the first RF signal and the second RF signal.

As the transmission line impedance is closely matched to a specific impedance (for example, 50 ohms), a reflection phenomenon in the process of providing the first RF signal and the second RF signal may be reduced. Thus, as the design freedom of the connection point of the first patch 120*a* and the first feed via 131*a* and the connection point of the second patch 120*b* and the second feed via 131*b* is higher, the gain of the first patch 120*a* and the second patch 120*b* may be further improved.

However, as the second feed via 131*b* passes through the first patch 120*a*, the second feed via 131*b* may be affected by the radiation of the first RF signal from the first patch 120*a*. Accordingly, the electromagnetic isolation between the first RF signal and the second RF signal may be deteriorated.

The chip antenna 100 according to an embodiment of the present disclosure includes a plurality of shielding vias 131*c* extended in a thickness direction of the first dielectric substrate 110*a* so that the electromagnetic isolation between the first RF signal and the second RF signal may be improved.

The plurality of shielding vias 131*c* has a shape surrounding the second feed via 131*b* and is disposed around the second feed via 131*b* and may thus improve the electromagnetic isolation between the first RF signal and the second RF signal.

The plurality of shielding vias 131*c* may be connected to the ground potential. As an example, the plurality of shielding vias 131*c* may be electrically connected to the ground layer 16*b* of the mounting substrate 10, through a predetermined pad and wiring via. The plurality of shielding vias 131*c*, connected to the ground potential, may be connected to the first patch 120*a*. According to an embodiment, the plurality of shielding vias may be formed to be spaced apart from the first patch 120*a* by a predetermined distance.

Due to the plurality of shielding vias 131*c*, a first RF signal, radiated toward a second feed via 131*b*, of the first RF signal radiated from the first patch 120*a*, may be blocked. Thus, the electromagnetic isolation between the first RF signal and the second RF signal may be improved, and the gain of each of the first patch 120*a* and the second patch 120*b* may be improved.

The plurality of shielding vias 131*c* may be arranged to surround each of the two feed vias of the second feed via 131*b*. Accordingly, the electromagnetic isolation of horizontal polarization and vertical polarization due to two feed vias of the second feed via 131*b* may be further improved, and the overall gain of the second patch 120*b* may be further improved.

The first feed via 131*a*, the second feed via 131*b*, and a plurality of shielding vias 131*c* according to the embodiment described above may be applied to various embodiments of the present disclosure.

Figure 9:
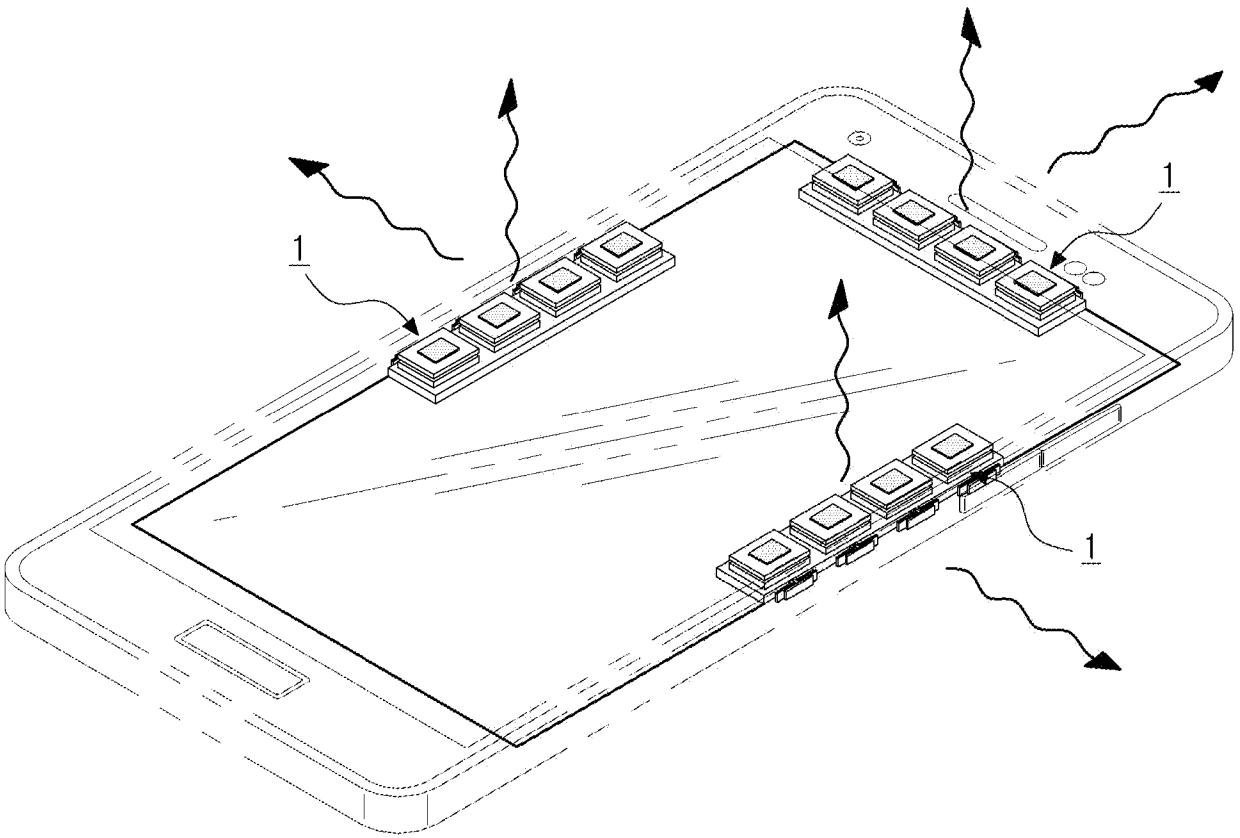
FIG. 9 is a schematic perspective view illustrating a mobile terminal with a chip antenna module mounted therein according to an embodiment of the present disclosure.

FIG. 9 is a schematic perspective view illustrating a mobile terminal with a chip antenna module mounted therein according to an embodiment of the present disclosure chip antenna module.

Referring to FIG. 9, a chip antenna module 1 according to an embodiment may be disposed adjacent to an edge of a mobile terminal. As an example, the chip antenna modules 1 are disposed to oppose each other in a side in a longitudinal direction or a side in a width direction. In an embodiment, the case is described by way of example, in which chip antenna modules are disposed in all of two sides in a longitudinal direction and one side in a width direction of a mobile terminal, but it is not limited thereto. Alternatively, when an internal space of a mobile terminal is insufficient, the arrangement structure of a chip antenna module may be modified in various forms as necessary, such as only two chip antenna modules are disposed in a diagonal direction of a mobile terminal. The RF signal, radiated through a chip antenna of the chip antenna module 1, is radiated in a thickness direction of a mobile terminal, while the RF signal, radiated through an end-fire antenna of the chip antenna module 1, is radiated in a direction perpendicular to a side in a longitudinal direction or a width direction of the mobile terminal.

As set forth above, according to an embodiment in the present disclosure, in a chip antenna, one of a first dielectric substrate and a second dielectric substrate is formed of PTFE, and durability and brittleness may be improved and thus reliability of a chip antenna may be significantly improved.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna, comprising:

a first dielectric substrate;

a second dielectric substrate spaced apart from and opposing the first dielectric substrate;

a first patch disposed on the first dielectric substrate;

a second patch disposed on the second dielectric substrate; and a mounting pad and a feed pad disposed on a mounting surface of the first dielectric substrate, wherein the first dielectric substrate, mounted on a mounting substrate through the mounting pad, is electrically connected to the mounting substrate through the feed pad, one of the first dielectric substrate and the second dielectric substrate is formed of ceramic and another is formed of polytetrafluoroethylene (PTFE), the first patch is disposed on one surface of the first dielectric substrate opposing the second dielectric substrate, and the chip antenna further comprises at least one first feed via extended in a thickness direction of the first dielectric substrate and connected to the first patch.

2. The chip antenna of claim 1, wherein the first dielectric substrate is formed of ceramic and the second dielectric substrate is formed of PTFE.

3. The chip antenna of claim 1, wherein the first dielectric substrate is formed of PTFE and the second dielectric substrate is formed of ceramic.

4. The chip antenna of claim 1, wherein the second patch is disposed on one surface of the second dielectric substrate opposing the first dielectric substrate, and the chip antenna further comprises at least one second feed via extended in a thickness direction of the first dielectric substrate, passing through a through-hole of the first patch, and connected to the second patch.

5. The chip antenna of claim 4, further comprising:

a plurality of shielding vias disposed around the at least one second feed via.

6. The chip antenna of claim 4, further comprising:

a third patch disposed on the another surface opposite to the one surface of the second dielectric substrate.

7. The chip antenna of claim 1, further comprising:

a spacer disposed between the first dielectric substrate and the second dielectric substrate.

8. The chip antenna of claim 1, further comprising:

a bonding layer disposed between the first dielectric substrate and the second dielectric substrate.

9. A chip antenna, comprising:

a dielectric substrate portion comprising a first dielectric substrate stacked on a second dielectric substrate;

a patch portion comprising a first patch and a second patch, sequentially provided in the dielectric substrate portion, and spaced apart from each other; and a mounting pad and a feed pad disposed on a mounting surface of the first dielectric substrate, wherein the first dielectric substrate, mounted on a mounting substrate through the mounting pad, is electrically connected to the mounting substrate through the feed pad, one of the first dielectric substrate and the second dielectric substrate is formed of ceramic and another is formed of PTFE, and one of the first dielectric substrate and the second dielectric substrate formed of PTFE embeds one of the first patch and the second patch.

10. The chip antenna of claim 9, wherein the first dielectric substrate and the second dielectric substrate are directly bonded to each other.

11. The chip antenna of claim 9, wherein the first dielectric substrate is formed of ceramic and the second dielectric substrate is formed of PTFE.

12. The chip antenna of claim 11, wherein the first patch, disposed on one surface of the first dielectric substrate bonded to the second dielectric substrate, protrudes toward the second dielectric substrate, and the second patch is embedded inside the second dielectric substrate.

13. The chip antenna of claim 9, wherein the first dielectric substrate is formed of PTFE and the second dielectric substrate is formed of ceramic.

14. The chip antenna of claim 13, wherein the first patch is embedded inside the first dielectric substrate, and the second patch, disposed on one surface of the second dielectric substrate bonded to the first dielectric substrate, protrudes toward the first dielectric substrate.

15. A chip antenna, comprising:

a first patch disposed on a first dielectric substrate; and a second patch, spaced apart from the first patch, disposed on a second dielectric substrate, wherein the first dielectric substrate is connected to a mounting substrate through a feed pad, and wherein one of the first dielectric substrate and the second dielectric substrate is formed of ceramic and another is formed of polytetrafluoroethylene (PTFE), the first patch, disposed on one surface of the first dielectric substrate bonded to the second dielectric substrate, protrudes toward the second dielectric substrate, and the second patch is embedded inside the second dielectric substrate.

16. The chip antenna of claim 15, wherein the first dielectric substrate and the second dielectric substrate are directly bonded to each other.

17. The chip antenna of claim 15, wherein one of the first dielectric substrate and the second dielectric substrate formed of PTFE embeds one of the first patch and the second patch.

* * * * *